US006532860B2

(12) United States Patent
Ota et al.

(10) Patent No.: US 6,532,860 B2
(45) Date of Patent: Mar. 18, 2003

(54) PISTON TYPE COMPRESSOR AND INNER MOLD FOR MAKING THE SAME

(75) Inventors: Masaki Ota, Kariya (JP); Masahiro Kawaguchi, Kariya (JP)

(73) Assignee: Kabushiki Kaisha Toyoda Jidoshokki Seisakusho, Kariya (JP)

( * ) Notice: Subject to any disclaimer, the term of this patent is extended or adjusted under 35 U.S.C. 154(b) by 0 days.

(21) Appl. No.: 09/863,184

(22) Filed: May 23, 2001

(65) Prior Publication Data

US 2002/0011149 A1 Jan. 31, 2002

(30) Foreign Application Priority Data

May 24, 2000 (JP) ..... 2000-152451

(51) Int. Cl.[7] ..... F01B 3/00
(52) U.S. Cl. ..... 92/71
(58) Field of Search ..... 92/71, 165 PR

(56) References Cited

U.S. PATENT DOCUMENTS

| | | | | | |
|---|---|---|---|---|---|
| 5,615,599 | A | * | 4/1997 | Terauchi | 92/165 PR |
| 5,706,716 | A | * | 1/1998 | Umemura | 60/165 PR |
| 5,771,775 | A | | 6/1998 | Ota et al. | 92/165 PR |
| 5,943,172 | A | * | 8/1999 | Terauchi | 92/165 PR |
| 5,988,041 | A | * | 11/1999 | Hiramatsu et al. | 92/71 |
| 6,010,313 | A | | 1/2000 | Kimura et al. | 417/222.2 |
| 6,325,599 | B1 | * | 12/2001 | Herder et al. | 92/165 PR X |
| 6,367,368 | B1 | * | 4/2002 | Ganster et al. | 92/71 |

FOREIGN PATENT DOCUMENTS

| | | | |
|---|---|---|---|
| EP | 0 740 076 A2 | 10/1996 | F04B/27/08 |
| JP | 8-337112 | 12/1996 | B60H/1/32 |
| JP | 10-054348 | 2/1998 | F04B/27/08 |
| JP | 10-089246 | 4/1998 | F04B/27/08 |
| JP | 10-169558 | 6/1998 | F04B/39/00 |
| JP | 11-201037 | 7/1999 | F04B/39/00 |

* cited by examiner

*Primary Examiner*—Edward K. Look
*Assistant Examiner*—Thomas E. Lazo
(74) *Attorney, Agent, or Firm*—Morgan & Finnegan, LLP

(57) ABSTRACT

The present invention provides a piston type compressor in which vibration and noise due to interference between the piston and the cam plate can be suppressed by preventing the rotation of the piston, and at the same time, it is possible to improve the productivity and accomplish the cost down. According to the present invention, the piston type compressor comprises a housing including a crank chamber and a cylinder block. A cylinder bore is formed in the cylinder block. A piston is accommodated in the cylinder bore so as to reciprocate. The piston is operatively connected to the cam plate. The piston reciprocates accompanying with rotation of the drive shaft so that drawing and discharging of a refrigerant is performed. A rotation preventing portion is formed on the piston, and a groove facing the rotation preventing portion so as to have clearance is formed on an inner circumferential surface of the crank chamber. By means of the abutment of the rotation preventing position with the groove, the rotation of the piston is prevented. The groove is formed to have draft smaller than that of other portions in the casting forming process.

9 Claims, 4 Drawing Sheets

PISTON TYPE COMPRESSOR AND INNER MOLD FOR MAKING THE SAME

BACKGROUND OF THE INVENTION

The present invention relates to a compressor, and more particularly, a piston type compressor that can prevent the rotation of the piston.

In a compressor to be used in an air conditioner for a vehicle, the following piston type compressor is known. The structure is a piston, connected to a cam plate operatively connected to a drive shaft, reciprocates in a cylinder bore to perform the compressive operation (for example, Japanese Unexamined Patent Publication No. 11-201037).

That is, in the above-described structure, the drive shaft is rotatably supported in a housing, and a swash plate as the cam plate is operatively connected to the drive shaft to rotate integrally. A cylinder bore is formed in the housing, and a head of a single-headed piston is inserted into the cylinder bore. A shoe seat is concavely formed in the inside of an arm portion of the piston located in the outside of the cylinder bore, and a shoe is received spherically in the shoe seat. A peripheral portion of the swash plate is slidably sandwiched by a pair of the shoes. Furthermore, the rotation of the swash plate accompanied by the rotation of the drive shaft is converted into the reciprocating movement of the piston via the shoes to perform a compression cycle of drawing, compressing and discharging the refrigerant gas into the cylinder bore.

As described above, connection structure between the piston and the swash plate via the shoes allows rotation of the piston about its own axis. If the rotation amount of the piston is large, the vicinity of the arm portion thereof interferes with the rotating swash plate so that vibration and noise tend to occur. Therefore, there is a case that a rotation preventing portion is formed on the arm portion of the piston so as to have a clearance with inner circumferential surface of the housing. The rotation preventing portion is abutted on the housing side to prevent a rotation of the piston when the piston has rotated by predetermined angle.

The housing is mostly manufactured by casting, and a draft for facilitating the separation from an inner mold used in the casting forming is set in the inner circumferential surface of the housing. The inner circumferential surface does not become parallel to reciprocating direction of the piston by virtue of the draft, and amount of the clearances is different between when the piston is at the top dead center and bottom dead center, respectively. Therefore, the inner circumferential surface has been mechanically processed by cutting, etc. so as to become parallel to the reciprocating direction of the piston.

For example, Japanese Unexamined Patent Publication No. 8-337112 discloses a structure that a cubic lug is formed on the outer circumferential surface of the piston, and a sliding groove that is engaged with the lug to be movable axially is formed on the inner circumferential surface of the housing so that the rotation of the piston can be prevented. In this structure, the lug and the sliding groove are formed by means of flat planning process that accompanies a lot of transfer of tools. Furthermore, the above publication also discloses a structure that a rotation preventing portion having an arc convex surface that has a curvature radius larger than the radius of a piston head is provided on the piston, and a recessed portion having an arc concave surface that has a curvature radius larger than the radius of the piston head is provided in the inner circumferential surface of the housing such that the recessed portion is spaced apart from the arc convex surface by predetermined distance. In this structure, though the portions to be processed are reduced than that of the aforementioned constitution, a mechanical processing should be performed after the casting.

However, the mechanical processing of the housing has low productivity, and has been become a factor that causes a cost up. When the mechanical processing is omitted, the draft of the inner circumferential surface needs to be set to be small, so that the drawing of the inner mold becomes difficult and the yield ratio grows worse, and as a result, the productivity is lowered.

SUMMARY OF THE INVENTION

Therefore, in view of the aforementioned problems, the object of the present invention is to provide a piston type compressor having a structure that vibration and noise due to interference between the piston and the cam plate can be suppressed by preventing the rotation of the piston, and at the same time, the productivity thereof is high and cost down can be attained.

To solve the above problem, according to the present invention, there is provided a piston type compressor in which a crank chamber is formed within a housing and a drive shaft is rotatably supported in the housing, a cylinder bore being formed in a cylinder block constructing a part of the housing, a piston being accommodated in the cylinder bore so as to be reciprocally moved, a cam plate being operatively connected to the drive shaft, the piston being operatively connected to the cam plate, the piston reciprocating accompanying with the rotation of the drive shaft so that the drawing and the discharging of refrigerant gas is performed, wherein a rotation preventing portion formed on the piston and a groove extending in the axial direction of the piston is formed on an inner circumferential surface of the crank chamber so that the piston is prevented from rotating about its own axis by abutting the rotation preventing portion on the groove; and wherein the crank chamber is formed using an inner mold removable in the axial direction of the piston, and a draft of the groove is set to be small in the inner circumferential surface of the crank chamber.

According to the present invention, when the piston has rotated about its own axis upon receiving the external force by any reasons, the rotation preventing portion provided on the piston abuts on the groove formed in the inner circumferential surface of the crank chamber, so that the rotation amount of the piston is restricted within the predetermined angle. Thereby, it is possible to prevent the interference between the piston and the cam plate and the like, and suppress vibration and noise due to the interference. Also, the groove in the inner circumferential surface of the crank chamber has a draft set to be smaller than those of other portions, and the portions except for the groove may have a draft set to facilitate mold release. Accordingly, it is possible to reduce the portions having small draft and facilitate the mold release, so that the productivity can be improved.

Furthermore, the present invention has such a feature that the above groove is constituted by a cast-forming surface.

According to the present invention, the groove is just as a casting surface, a mechanical processing for finishing the groove can be omitted, thereby, it is possible to improve productivity. Also, although a surface hardened layer is formed in the groove during the casting process, the surface hardened layer is removed if the mechanical processing is performed, so that it becomes a factor that lowers the strength of the housing. In this invention, it is possible to positively leave the surface hardened layer by omitting the mechanical processing and to contribute to improvement of the strength of the housing.

Furthermore, the present invention has a following feature. The above rotation preventing portions are provided two per each piston and one groove per each rotation preventing portion is formed in the inner circumferential surface of the crank chamber, and a recess is formed between the two rotation preventing portions of the piston to obviate an interference with the inner circumferential surface of the crank chamber.

According to the present invention, it is possible to reduce the weight of the piston since the rotation preventing portion can be miniaturized. Also, it is possible to reduce the mold release resistance and to extend durability of the mold because width of the groove having a draft set to be small can be narrowed.

Furthermore, the present invention has a following feature. The above inner mold is provided with a projection which forms the groove, and the projection is detachably mounted to the inner mold.

According to the present invention, the above groove is formed by the projection of the inner mold used when forming the housing that constitutes the inner circumferential surface. Since the projection has a draft set to be small, the resistance due to friction, etc. becomes large upon the mold release so that the projection deteriorates or wears easily. Therefore, maintenance such as partial repair is required very often. In case where the partial repair was repeated and the improvement is no longer possible by the partial repair, the exchange is needed. In this invention, it is unnecessary to exchange the entire inner mold because the projection is detachably mounted to the inner mold. Accordingly, it is advantageous in terms of the production cost.

BRIEF DESCRIPTION OF THE DRAWINGS

The features of the present invention that are believed to be novel are set forth with particularity in the appended claims. The invention together with objects and advantages thereof, may best be understood by reference to the following description of the presently preferred embodiments together with the accompanying drawings in which:

DETAILED DESCRIPTION OF THE PREFERRED EMBODIMENTS

Now, an embodiment of the present invention will be explained based on examples with reference to FIGS. 1 to 5.

Figure 1:
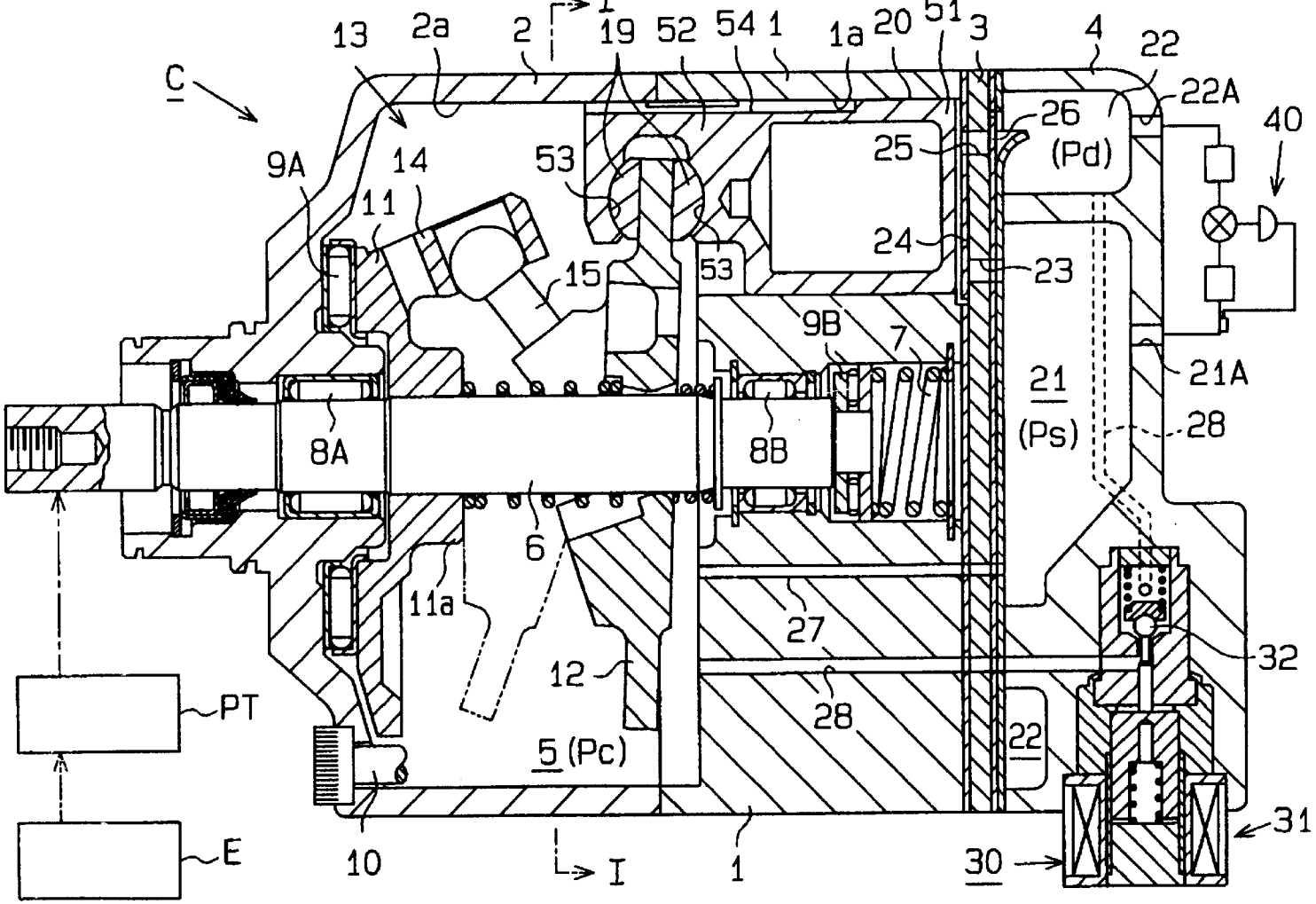
FIG. 1 is a cross sectional view schematically showing a piston type compressor according to an embodiment of the invention.

As shown in FIG. 1, a piston type compressor C is provided with a cylinder block 1, a front housing 2 connected to a front end of the cylinder block 1, and a rear housing 4 connected to a rear end of the cylinder block 1 via a valve plate assembly 3. The cylinder block 1, the front housing 2, the valve plate assembly 3 and the rear housing 4 are fixed one another by means of a plurality of through bolts 10 (only one is shown in FIG. 1) to constitute a housing assembly of the piston type compressor C. A crank chamber 5 is defined in a region surrounded by the cylinder block 1 and the front housing 2. A drive shaft 6 is rotatably supported by means of a pair of front and rear radial bearings 8A, 8B within the crank chamber 5. A spring 7 and a rear thrust bearing 9B are arranged within an accommodating recess formed in the center of the cylinder block 1. On the other hand, a lug plate 11 is fixed on the drive shaft 6 to rotate integrally therewith in the crank chamber 5, and a front thrust bearing 9A is arranged between the lug plate 11 and an inner wall surface of the front housing 2. The integrated drive shaft 6 and lug plate 11 are positioned in the thrust direction (axial direction of the drive shaft) by means of the rear thrust bearing 9B and a front thrust bearing 9A which are forwardly urged by the spring 7.

A front end of the drive shaft 6 is operatively connected to a vehicle engine E as an external driving source via a power transmission mechanism PT. The power transmission mechanism PT may be a clutch mechanism, which can select transmission/interception of power by means of an external electric control (for example, an electromagnetic clutch) or an ordinary transmission type of clutch-less mechanism, which does not have such clutch mechanism (for example, combination of a belt/a pulley). Ordinarily, the present embodiment employs a clutch-less type power transmission mechanism.

As shown in FIG. 1, the crank chamber 5 accommodates a swash plate 12 as a cam plate. An inserting hole is formed through the center of the swash plate 12, and the drive shaft 6 is penetrated through the inserting hole. The swash plate 12 is operatively connected to the lug plate 11 and the drive shaft 6 via a hinge mechanism 13 as a connection guide mechanism. The hinge mechanism 13 is constituted with two support arms 14 (only one is shown) protruded from a rear surface of the lug plate 11 and two guide pins 15 (only one is shown) protruded from a front surface of the swash plate 12. By means of linkage of the support arms 14 with the guide pins 15 and contact of the drive shaft 6 with the swash plate 12 within the inserting hole at the center thereof, the swash plate 12 can be rotated synchronously with the lug plate 11 and the drive shaft 6, and at the same time, can be tilted with respect to the drive shaft 6 while accompanying axial slide movement along drive shaft 6. In the present description, an inclined angle of the swash plate 12 is defined as an angle between an imaginary plane perpendicular to the drive shaft 6 and the swash plate 12.

A plurality of cylinder bores 1*a* (five in the present embodiment) (only one is shown in FIG. 1) surrounding the drive shaft 6 are formed in the cylinder block 1, and a rear end of each cylinder bore 1a is blocked by the valve plate assembly 3. A single-headed piston 20 is accommodated in each cylinder bore 1*a* to be reciprocally moved, and a compression chamber is defined within each cylinder bore 1*a* to be volume displaced in accordance with the reciprocation of the piston 20. The front end of each piston 20 is engaged to an outer circumference of the swash plate 12 via a pair of shoes 19, and each piston 20 is operatively connected to the swash plate 12 via these shoes 19. Therefore, when the swash plate 12 is rotated synchronously with the drive shaft 6, the rotation of the swash plate 12 is converted into linear reciprocating movement of the piston 20 with the stroke corresponding to the inclined angle of the swash plate.

Furthermore, a suction chamber 21 placed in the central zone and a discharge chamber 22 surrounding the suction chamber are defined between the valve plate assembly 3 and the rear housing 4. The valve plate assembly 3 is constituted by means of superposing a suction valve plate, a port plate, a discharge valve plate and a retainer plate one upon another. A suction port 23 and a suction valve 24 which opens and closes the suction port 23 as well as a discharge port 25 and a discharge valve 26 which opens and closes the discharge port 25 are formed in the valve plate assembly 3 corresponding to each cylinder bore 1*a*. The suction chamber 21 communicates with each cylinder bore 1*a* via the suction port 23, and each cylinder bore 1 a communicates with the discharge chamber 22 via the discharge port 25.

The suction chamber 21 and the crank chamber 5 are connected via a bleeding passage 27. Also, the discharge chamber 22 and the crank chamber 5 are connected via a supply passage 28, and a control valve 30 is provided in the course of the supply passage 28.

The control valve 30 is provided with a solenoid unit 31 and a valve body 32 operatively connected to the solenoid unit 31 via a rod. The solenoid unit 31 is actuated by a current outputted from a drive circuit (not shown) based on a signal from a control computer (not shown) to change the position of the valve body 32, thereby, the opening of the supply passage 28 is adjusted.

Balance between inlet volume of high pressure gas into the crank chamber 5 via the supply passage 28 and outlet volume of a refrigerant gas from the crank chamber 5 via the bleeding passage 27 is controlled by adjusting the opening of the control valve 30, so that a crank pressure Pc is determined. Pressure difference between the crank chamber pressure Pc and inner pressure of the cylinder bore 1*a* via the piston 20 is changed in response to change of the crank chamber pressure Pc, and the inclined angle of the swash plate 12 is changed, and as a result, the stroke of the piston 20, namely, the discharge capacity is adjusted.

The rear housing 4 is provided with a suction passage 21A which acts as an inlet introducing the refrigerant gas into the suction chamber 21, and a discharge passage 22A which discharges the refrigerant from the discharge chamber 22 therethrough. The suction passage 21A and the discharge passage 22A are connected to an external refrigerant circuit 40.

Figure 2:
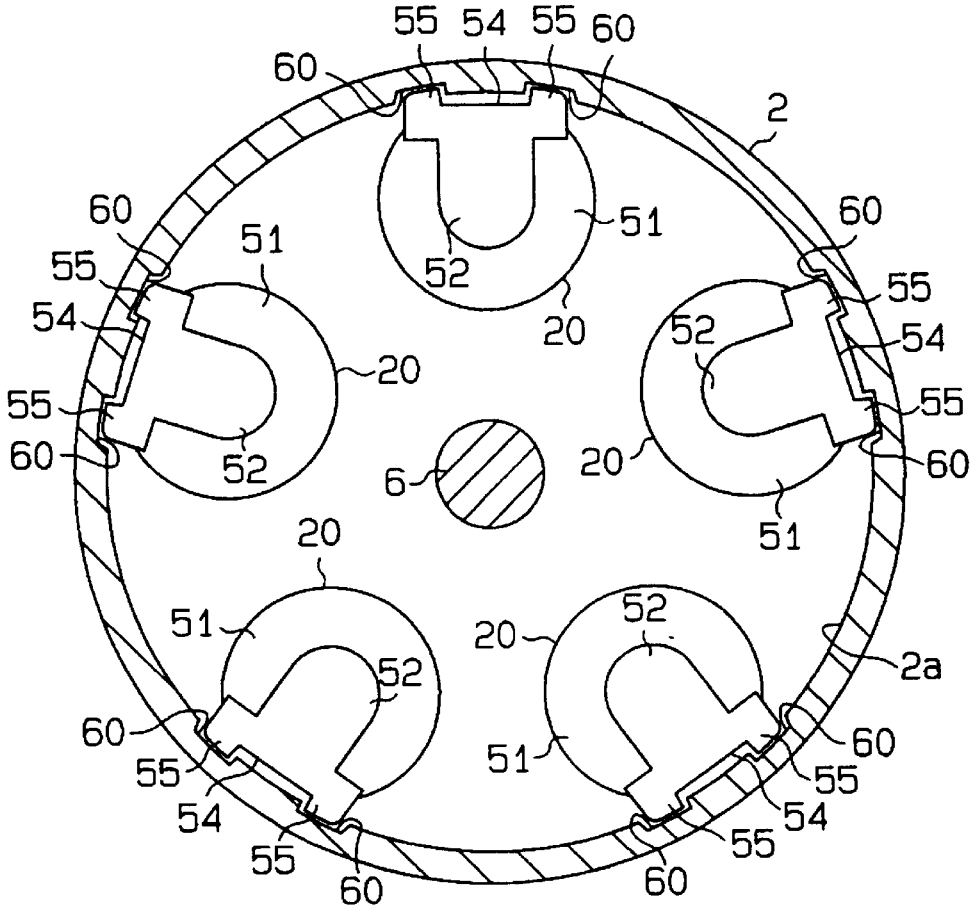
FIG. 2 is a diagrammatic cross sectional view taken along the line I—I in FIG. 1.

As shown in FIG. 1 and FIG. 2, the front housing 2 shows approximately cylindrical shape with its bottom. Within the front housing 2, each piston 20 is arranged such that its axis center is spaced apart at equal intervals from the inner circumferential surface 2*a* of the front housing 2 (the inner circumferential surface of the crank chamber 5). Also, in FIG. 2, the swash plate 12 is abbreviated.

Figure 3:
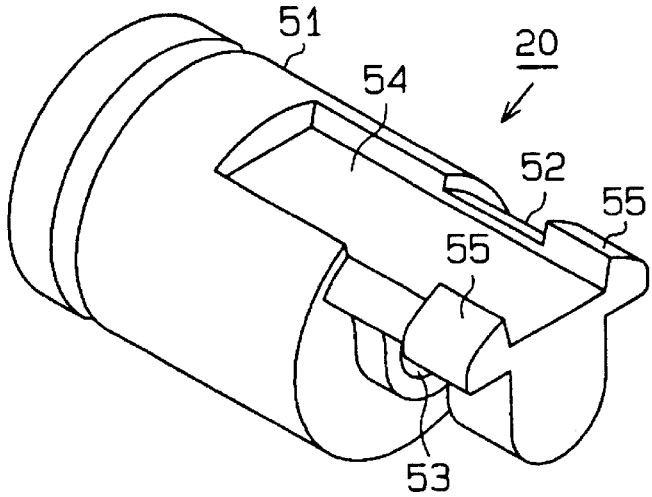
FIG. 3 is a perspective view schematically showing a piston.

As shown in FIG. 1 to FIG. 3, the piston 20 is provided with a cylindrical head portion 51 inserted into the cylinder bore 1*a* and an arm portion 52 disposed outside the cylinder bore 1*a*. A pair of shoe seats 53 are provided inside of the arm portion 52. The shoes 19 are contained in the arm portion 52, and spherically accommodated by the shoe seats 53. The swash plate 12 is slidably sandwiched at its outer circumference by a pair of shoes 19.

In the piston 20, a recess 54 extending from the middle of the head portion 51 to the end (front end) of the arm portion 52 is formed at a side facing to the inner circumferential surface 2*a* of the front housing 2. On the end of the arm portion 52, two rotation preventing portions 55 per each piston 20 are provided such that the recess 54 is sandwiched. As shown in FIG. 2, the rotation preventing portion 55 protrudes outwardly than the outer circumferential surface of the head portion 51. The rotation preventing portion 55 is formed as an arc cross sectional shape having larger curvature radius than the outer circumferential surface of the head portion 51 at the side facing to the inner circumferential surface 2*a* of the front housing 2.

As shown in FIG. 2, in the inner circumferential surface 2*a*, a plurality of grooves 60 (ten in the present embodiment) having rectangular cross sectional shapes are formed along axial direction of the piston 20 at a position corresponding to the rotation preventing portion 55 of the piston 20. The groove 60 extends from the front end to the rear end in the inner surface of the front housing 2 over substantially full length. In each groove 60, the rotation preventing portion 55 is provided respectively so as to have a clearance between the rotation preventing portion 55 and the groove 60. A part of the inner circumferential surface 2*a* (a part between each two grooves 60) is adapted to engage the recess 54 of the piston 20. Due to the clearance between the bottom of the groove 60 and the rotation preventing portion 55, the rotation preventing portion 55 is set to abut on the groove 60 when the piston 20 has rotated by predetermined angle about the axis of the piston 20. That is, the rotation preventing portion 55 and the groove 60 cooperate each other to prevent the piston 20 not to rotate more than the predetermined angle.

Figure 4:
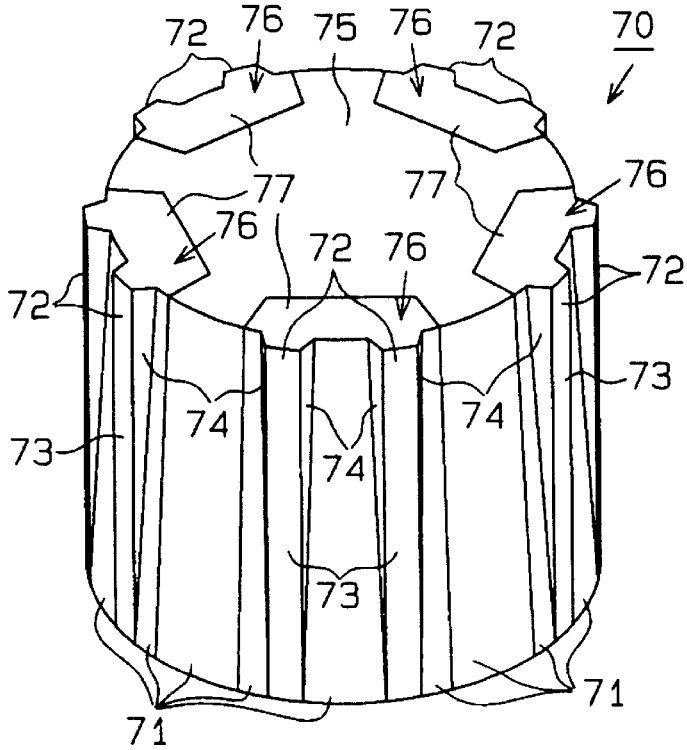
FIG. 4 is a diagrammatic perspective view showing an inner mold that molds a front housing.

FIG. 4 diagrammatically shows an inner mold 70 used when the front housing 2 is manufactured by the casting. An upper portion of FIG. 4 corresponds to a front side (left side in FIG. 1) of the piston type compressor. The inner mold 70 shows approximately truncated conical shape, and an outer circumferential surface 71 is inclined so as to be close to axis of the inner mold 70 (this axis is assumed to be parallel to the reciprocating direction of the piston 20) as goes upwardly. The inclined angle of the outer circumferential surface 71 with respect to the axis is defined as a draft. In a casting forming process, the draft moves a workpiece (the front housing 2 in the embodiment) or the inner mold 70 in the axial direction of the inner mold 70, and is set to reduce a mold release resistance produced between the work and the inner mold 70 upon separating the work from the inner mold 70 (mold release). The mold release resistance includes, for example, a friction resistance caused between the work and the inner mold 70, and a caulking between them due to tolerance of moving direction with respect to the axial direction, etc.

In the outer circumferential surface 71, a plurality of projections 72 (ten in the present embodiment) is protruded outwardly along the axial direction of the inner mold 70. An outer surface 73 and a side face 74 of each projection 72 are set such that each inclined angle of the surface 73 and of the face 74 to the axis of each projection 72 is smaller than that of the outer circumferential surface 71 to the axis of the inner mold 71 so as to be substantially parallel to the axis of the inner mold 70. Namely, the inclination angle, or the draft is set to become extremely small. The groove 60 of the front housing 2 is formed by the projection 72. Namely, an inner surface and a side face constituting the groove 60 are substantially parallel to the reciprocating direction of the piston 20, and the clearance between the rotation preventing portion 55 of the piston 20 and the groove 60 is formed so as not to be changed between when the piston 20 is positioned at the top dead center and at the bottom dead center, respectively.

Furthermore, the inner circumferential surface 2*a* of the front housing 2 including the groove 60 is composed by a cast-forming surface (casting surface) as a whole.

Figure 5:
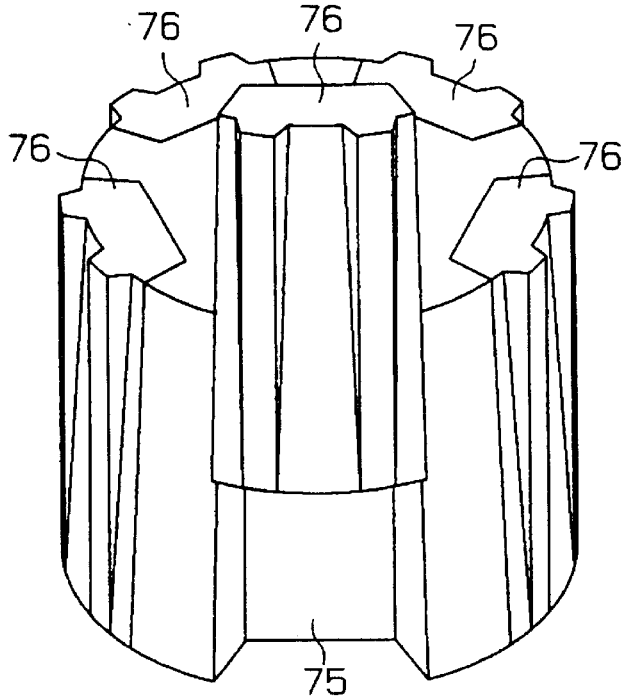
FIG. 5 is a diagrammatic perspective view showing the state that a pedestal is displaced from the inner mold of FIG. 4.

As shown in FIG. 4 and FIG. 5, the inner mold 70 is constituted with a main body 75 occupying most volume thereof, and a projection unit 76. The main body 75 shows an approximately pentagonal cylindrical shape, and the projection unit 76 is protruded outwardly from the outer circumferential surface 71. The projection unit 76 is provided with pedestals 77 having a face that constitutes the outer circumferential surface 71 of the inner mold 70. The pedestals 77 shows an approximately tetragonal cylindrical shape, and the above-mentioned two projections 72 are provided in each pedestal 77. The main body 75 and the projection unit 76 can be attached and detached each other. One main body 75 and five projection units 76 form one inner mold 70.

Next, operation of the piston type compressor constructed as above will be explained.

When a drive power is supplied from the vehicle engine E to the drive shaft 6 via the power transmission mechanism PT, the swash plate 12 rotates along with the drive shaft 6. Accompanying with the rotation of the swash plate 12, each piston 20 is reciprocated with the stroke corresponding to the inclined angle of the swash plate 12, and drawing, compressing and discharging of the refrigerant are repeated successively in each cylinder bore 1*a*.

In case of large cooling load, the control computer sends a command signal to the drive circuit such that the supplying current value onto the solenoid unit 31 becomes large. Due to change of the current value from the drive circuit based on the signal, the solenoid unit 31 increases the urging force such that the valve body 32 makes the opening of the supply passage 28 be smaller. As a result, the valve body 32 moves so that the opening of the supply passage 28 becomes small. Thereby, the volume of high pressure refrigerant gas supplied from the discharge chamber 22 to the crank chamber 5 via the supply passage 28 becomes small, the pressure in the crank chamber 5 is lowered, and the inclined angle of the swash plate 12 becomes large, and thus, discharge capacity of the piston type compressor C becomes large. When the supply passage 28 is entirely closed, the pressure in the crank chamber 5 is remarkably lowered, and the inclined angle of the swash plate 12 becomes maximized so that the discharge capacity of the piston type compressor C becomes maximized.

On the contrary, in case of small cooling load, the solenoid unit 31 decreases the urging force such that the valve body 32 makes the opening of the supply passage 28 be larger. As a result, the valve body 32 moves so that the opening of the supply passage 28 becomes large. Thereby, the pressure in the crank chamber 5 is raised, and the inclined angle of the swash plate 12 becomes small so that the discharge capacity of the piston type compressor C becomes small. When the supply passage 28 is entirely opened, the pressure in the crank chamber 5 is remarkably raised, and the inclined angle of the swash plate 12 becomes minimized so that the discharge capacity of the piston type compressor C becomes minimized.

The above-described connection structure between the piston 20 and the swash plate 12 via the shoes 19 allows the rotation of the piston 20 about its own axis. Accordingly, the piston 20 may happen to rotate about its own axis upon receiving an external force by any reasons. Particularly, the shoes 19 tend to rotate in the rotating direction of the swash plate 12 due to sliding with the swash plate 12. Therefore, the piston 20 during the operation of the piston type compressor tends to rotate in the rotating direction of the swash plate 12 by means of rotational force of the swash plate 12 received through the shoes 19.

However, the rotation of the piston 20 in the rotating direction of the swash plate 12 is prevented by the fact that the rotation preventing portion 55 at the rear side of the rotating direction is abutted on the groove 60. And, the rotation of the piston 20 in the reverse direction to the rotating direction of the swash plate 12 is prevented by the fact that the rotation preventing portion 55 at the front side of the rotating direction is abutted on the groove 60.

According to the present embodiment, the following effects can be obtained.

(1) Because the rotation preventing portion 55 is provided in the piston 20 and is accommodated within the groove 60 formed in the front housing 2 with a clearance, the rotation amount of the piston 20 can be small so that the interference between the vicinity of the arm portion 52 of the piston 20 and the swash plate 12 can be prevented. Accordingly, vibration and noise due to the interference between the piston 20 and the swash plate 12 can be prevented.

(2) Because the inner circumferential surface side of the front housing 2 does not have mechanical components and the like, and the groove 60 is formed in the inner circumferential surface 2*a* of the front housing 2 having wide freedom of design, the workability can be improved.

(3) Because the groove 60 is formed in the inner circumferential surface 2*a*, and the draft of the groove 60 upon the casting forming is set to be small, and at the same time, the inner circumferential surface 2*a* except for the groove 60 has a draft requisite for the mold release, the mold release is performed smoothly.

(4) Because the clearance is provided between the rotation preventing portion 55 and the groove 60, and the rotation preventing portion 55 is abutted on the groove 60 when the piston 20 has rotated by predetermined angle, the piston 20 does not slide in a state that it receives eccentric load so that the partial wear of the piston 20 is prevented.

(5) Because the surface constituting the groove 60 is substantially parallel to the reciprocating direction of the piston 20, and the amount of the clearance between the rotation preventing portion 55 of the piston 20 and the groove 60 is substantially unchanged when the piston 20 is disposed at the top dead center and the bottom dead center, respectively, it is possible to make the rotation restriction amount of the piston 20 be substantially equal in an entire range of piston stroke.

(6) Because the inner mold 70 is constituted with the main body 75 and the projection unit 76, and the projection unit 76 can be attached and detached with respect to the inner mold 70, it is possible to exchange only the projection unit 76 that is a part of the inner mold 70. Because the projection 72 having a small draft is locally subjected to the deterioration and the wear due to the sliding friction occurred between the workpiece (the front housing 2) and the projection unit upon the mold release, the exchange of the projection unit 76 remarkably contributes to the cost down.

(7) Because the rotation preventing portion 55 is integrally formed with the arm portion 52 of the piston 20, strength thereof can be improved (this enables to reduce the weight of the piston 20) compared with a case that a separate rotation preventing member is assembled to the piston 20, and at the same time, because the dimension accuracy is not required compared with the latter case, the cost down can be attained.

(8) Each piston 20 has two rotation preventing portions 55, and rotation preventing action with respect to each rotating direction of the piston 20 is allotted to the respective rotation preventing portions 55. Accordingly, each rotation preventing portion 55 becomes small compared with a case that the both rotation preventing portions 55 are formed continuously, so that the reducing the weight of the piston 20 becomes possible. Also, in accordance with the miniaturization of each rotation preventing portion 55, it is possible to narrow the width of the groove 60. If the width of the groove 60 is narrowed, the width of the projection 72 for forming the groove can be narrowed. Because the projection 72 is set to have small draft and is subjected to relatively large mold release resistance, narrowing the width of the projection 72 makes the mold release resistance be small, and at the same time, can extend a durability of the mold.

(9) Because the entire inner circumferential surface 2*a* of the front housing 2 including the groove 60 is formed by the cast-forming surface (casting surface), a mechanical processing for finishing the groove 60 can be omitted, thereby, it is possible to improve the productivity and accomplish the cost down. Although a surface hardened layer is formed in the groove 60 during the casting process, the surface hardened layer is removed if the mechanical processing is performed, so that it becomes a factor that lowers the strength of the front housing 2. In the present embodiment, it is possible to positively leave the surface hardened layer by omitting the mechanical processing and contribute to improvement of the strength of the front housing 2.

The embodiments are not limited to the above description, and may include the following embodiments.

Although the piston type compressor C has five pistons 20 in the above embodiment, it is not limited to this embodiment, and for example, may have six, seven or not more than four pistons.

Although the piston type compressor C is a variable displacement type that can change the stroke of the piston 20, it may be fixed displacement type of which the stroke is fixed.

Although the piston type compressor C is a single-headed type having a single-headed piston 20, it may be a double-headed type that cylinder blocks are provided in front and rear of the crank mechanism, respectively to reciprocate a double-headed piston.

Figure 6:
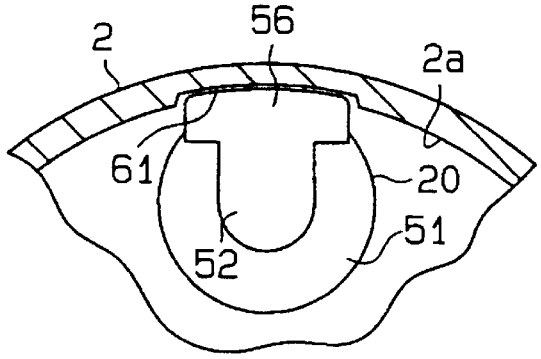
FIG. 6 is a partial diagrammatic cross sectional view showing a rotation preventing portion and a groove according to another embodiment.

Although two rotation preventing portions 55 are provided in each piston 20, one rotation preventing portion may be provided. For example, as shown in FIG. 6, a groove 61 having wide width may be formed in the front housing 2, and one rotation preventing portion 56 which prevents the rotation of the piston 20 in the both rotating direction may be disposed in the groove 61 so as to have clearance between them.

Figure 7:
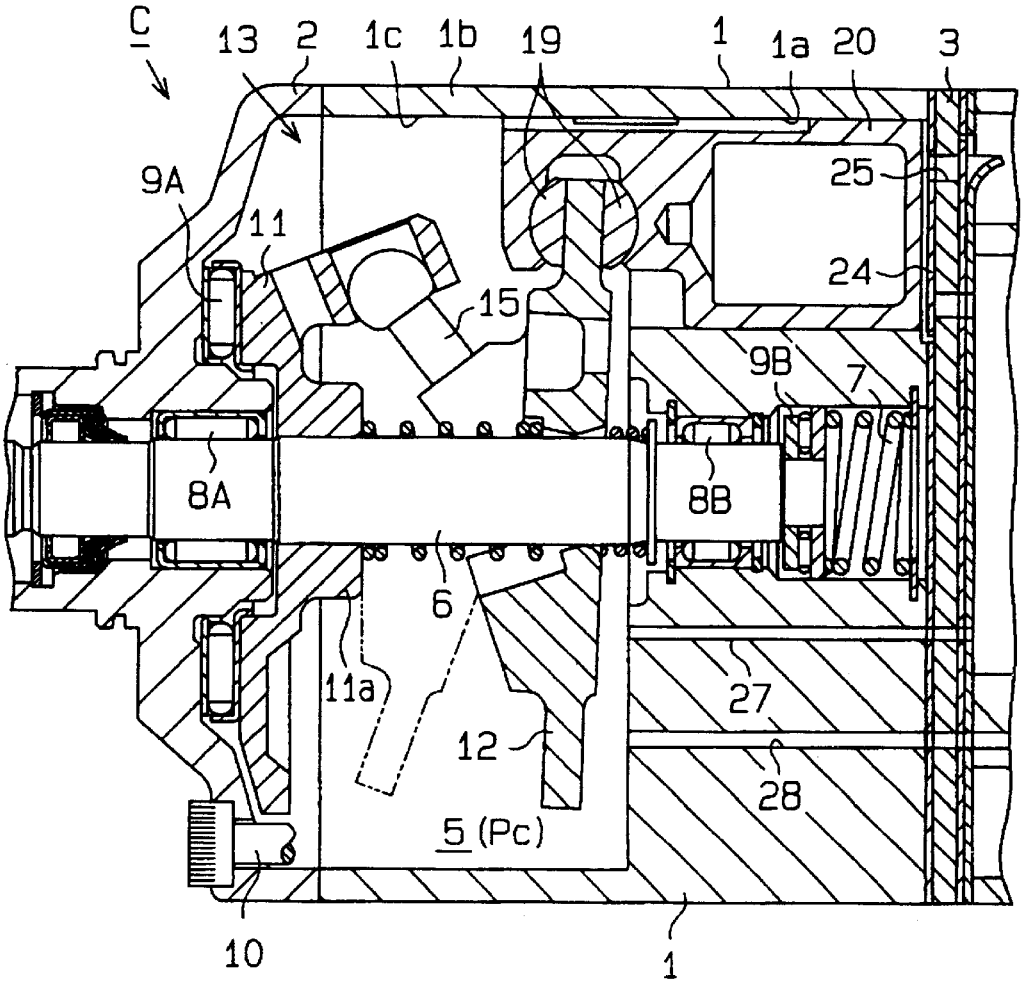
FIG. 7 is a partial cross sectional view schematically showing a housing according to another embodiment.

As shown in FIG. 7, a wall portion 1*b* of the cylinder block 1 may extend to a front housing 2 side, and a groove that prevents the rotation of the piston 20 in cooperation with the rotation preventing portion provided in the piston 20 may be formed in an inner circumferential surface 1*c* of the wall portion 1*b*.

Although two projections 72 are provided on each projection unit 76, the projection unit 76 may have a small width (a width along a circumferential direction of the inner mold 70), and one projection 72 may be provided on each projection unit 76. Thereby, it is possible to exchange the projection 72 as one unit.

Although the projection unit 76 can be attached to and detached from the inner mold 70, it may be an integral type that is not partially attachable and detachable.

After forming the groove 60 by the casting, the groove 60 may be subjected to a mechanical processing to follow the axial direction of the piston 20 more. In this case, it is possible to further improve the accuracy in maintaining the clearance with the rotation preventing portion 55. Because the mechanical processing is further performed in the groove 60 having small draft, the processing amount in the mechanical processing is reduced compared with the mechanical processing in the state that the groove 60 is not formed by the casting or the state that the groove 60 has the same draft as that of other parts of the inner circumferential surface 2*a*. Accordingly, it is possible to accomplish the cost down by shortening the processing time for the mechanical processing, etc.

Furthermore, the technical sprits that can be grasped by the above-mentioned embodiment are described below with the effect thereof.

The rotation preventing portion is integrally formed in the piston. In this case, the cost down can be attained owing to allowance of dimension accuracy in addition to improvement of the strength and lightening compared with the case that the separate rotation preventing member is assembled.

The inner circumferential surface of the crank chamber is made as the inner circumferential surface of the front housing adjacent to the cylinder block. In this case, the mechanical components and the like are not disposed in the inner circumferential surface of the front housing, and the selection range of the design is wide, so that the workability is improved.

As described above, according to the present invention, in the piston type compressor, vibration and noise due to interference between the piston and the cam plate can be suppressed by preventing the rotation of the piston, and at the same time it is possible to improve the productivity and accomplish the cost down.

Therefore, the present examples and embodiments are to be considered as illustrative and not restrictive and the invention is not to be limited to the details given herein, but may be modified within the scope and equivalence of the appended claims.

What is claimed is:

1. A piston type compressor comprising:

a housing including a crank chamber, a cylinder block that forms cylinder bores, an inner circumferential surface of the housing forming a groove that extends in an axial direction of the piston;

a drive shaft rotatably supported in the housing;

a cam plate operatively connected to the drive shaft; and a piston accommodated in each cylinder bore, the piston being operatively connected to the cam plate, the piston including a rotation prevention portion, the piston being prevented from self-rotating by engaging said rotation preventing portion with said groove, wherein the rotation of the drive shaft is converted to the reciprocating movement of each piston, whereby drawing and discharging refrigerant is performed, and wherein the inner circumferential surface of the housing is formed by using an inner mold, which is removable in the axial direction of the piston, said inner circumferential surface of said housing being formed by an outer circumferential surface of the inner mold that is inclined at a first angle with respect to the axial axis of the inner mold and said groove being formed by a projection on the inner mold that is inclined at a second angle with respect to the axial axis of the inner mold, wherein the second angle is less than the first angle.

2. The piston type compressor according to claim 1, wherein said groove is constituted by a cast-forming surface.

3. The piston type compressor according to claim 2, wherein an entire inner circumferential surface of the housing, including said groove, is formed by the cast-forming surface.

4. The piston type compressor according to claim 1, wherein a surface constituting said groove is substantially parallel to the reciprocating direction of the piston.

5. The piston type compressor according to claim 1, wherein said rotation preventing portion is integrally formed with an arm portion of the piston.

6. The piston type compressor according to claim 1, wherein the piston has two rotation preventing portions, and each rotation preventing portion corresponds to one respective groove, and wherein a recess is formed, on the piston, between said two rotation preventing portions of the piston, to eliminate interference between the piston and the inner circumferential surface of the crank chamber.

7. An inner mold for making the piston type compressor having:

a housing including a crank chamber and a cylinder block that includes cylinder bores, an inner circumferential surface of a housing forming a groove that extends in an axial direction of the piston;

a drive shaft rotatably supported by the housing;

a cam plate operatively connected to the drive shaft;

a piston accommodated in each cylinder bore, the piston being operatively connected to the cam plate, the piston including a rotation preventing portion with said groove, wherein the rotation of the drive shaft is converted to the reciprocating movement of each piston, whereby drawing and discharging refrigerant is performed, wherein the inner circumferential surface of the housing is formed by using an inner mold which is removable in the axial direction of the piston, said inner circumferential surface of said housing being formed by an outer circumferential surface of the inner mold that is inclined at a first angle with respect to the axial axis of the inner mold and said groove being formed by a projection on the inner mold that is inclined at a second angle with respect to the axial axis of the inner mold, wherein the second angle is less than the first angle.

8. An inner mold for making the piston type compressor according to claim 7, wherein said inner mold is constituted by a main body and a projection unit; and wherein said projection unit can be attached and detached with respect to said main body.

9. An inner mold for making the piston type compressor having a housing including a crank chamber and a cylinder block that includes cylinder bores, an inner circumferential surface of the housing forming a groove that extends in an axial direction of the piston, a drive shaft rotatably supported by the housing, a cam plate operatively connected to the drive shaft, a piston accommodated in each cylinder bore, the piston being operatively connected to the cam plate, the piston including a rotation preventing portion, the piston being prevented front self-rotating by engaging said rotation preventing portion with said groove, wherein the rotation of the drive shaft is converted to the reciprocating movement of each piston, whereby drawing and discharging refrigerant is performed, and wherein the inner circumferential surface of the housing is formed by using said inner mold, which is removable in the axial direction of the piston, said inner circumferential surface of said housing being formed by an outer circumferential surface of the inner mold that is inclined at a first angle with respect to the axial axis of the inner mold and said groove being formed by a projection on the inner mold that is inclined at a second angle with respect to the axial axis of the inner mold, wherein the second angle is less than the first angle.

* * * * *

UNITED STATES PATENT AND TRADEMARK OFFICE

CERTIFICATE OF CORRECTION

PATENT NO. : 6,532,860 B2
DATED : March 18, 2003
INVENTOR(S) : Masaki Ota and Masahiro Kawaguchi It is certified that error appears in the above-identified patent and that said Letters Patent is hereby corrected as shown below:

Column 12,
Line 23, please change “front self-rotating” to -- from self-rotating --.

Signed and Sealed this

Ninth Day of September, 2003

JAMES E. ROGAN
*Director of the United States Patent and Trademark Office*